US011097173B1

(12) United States Patent
Celenza, Jr.

(10) Patent No.: US 11,097,173 B1
(45) Date of Patent: Aug. 24, 2021

(54) LIGHT SOURCE ILLUMINATING THE RIM, NET AND BACKBOARD OF A BASKETBALL SYSTEM

(71) Applicant: Louis Celenza, Jr., McKinney, TX (US)

(72) Inventor: Louis Celenza, Jr., McKinney, TX (US)

( * ) Notice: Subject to any disclaimer, the term of this patent is extended or adjusted under 35 U.S.C. 154(b) by 0 days.

(21) Appl. No.: 16/925,074

(22) Filed: Jul. 9, 2020

(51) Int. Cl.
*A63B 63/08* (2006.01)
*A63B 71/06* (2006.01)

(52) U.S. Cl.
CPC ..... *A63B 63/083* (2013.01); *A63B 71/0622* (2013.01); *A63B 2071/0694* (2013.01); *A63B 2220/833* (2013.01); *A63B 2225/74* (2020.08)

(58) Field of Classification Search
CPC ..... A63B 63/08; A63B 63/083
USPC ..... 473/479–489
See application file for complete search history.

(56) References Cited

U.S. PATENT DOCUMENTS 4,858,920 A * 8/1989 Best ..... A63B 24/0021 473/480
4,956,775 A * 9/1990 Klamer ..... A63B 24/0021 340/323 R
4,984,787 A * 1/1991 Nesbit ..... A63B 63/083 473/481
5,305,998 A * 4/1994 Nesbit ..... A63B 63/083 473/481
5,403,000 A * 4/1995 Woosley ..... A63B 43/06 473/447
5,711,727 A * 1/1998 Edge ..... A63B 63/083 473/479
5,833,558 A * 11/1998 Pettie ..... A63B 63/083 473/479
5,916,048 A * 6/1999 Hurell ..... A63B 63/083 473/479
6,418,179 B1 * 7/2002 Shieh ..... A63B 63/083 377/5
7,210,818 B2 * 5/2007 Luk ..... H05B 45/20 362/231
7,347,606 B1 * 3/2008 Patten ..... F21V 15/013 362/152
7,360,284 B1 * 4/2008 Viani ..... B60P 7/0823 24/300
7,758,456 B1 * 7/2010 Dykes ..... A63B 63/083 473/479
7,854,528 B2 * 12/2010 Segretto ..... A63B 67/06 362/191
9,114,749 B2 * 8/2015 Ashliman ..... B60P 7/0823
9,119,255 B2 * 8/2015 Pijlman ..... H05B 45/00
10,371,233 B2 * 8/2019 Dershem ..... A63B 21/0557

* cited by examiner

*Primary Examiner* — Alvin A Hunter
(74) *Attorney, Agent, or Firm* — Plager Schack LLP; Mark H. Plager; Alexis J. Saenz

(57) ABSTRACT

A basketball illumination system includes a light source mounted beneath a basketball rim to prevent glare and improve visibility of the rim in low lit conditions. Some embodiments include an L.E.D. strip arranged in a hoop directly below the rim. A bungee cord may couple the L.E.D. strip to the rim under tension to prevent the L.E.D. strip from straying into the path of balls travelling through the rim. Some embodiments include a rebound sensor and/or a shot senor. Each sensor may change the illumination of the L.E.D. strip in a different way upon detection.

15 Claims, 5 Drawing Sheets

LIGHT SOURCE ILLUMINATING THE RIM, NET AND BACKBOARD OF A BASKETBALL SYSTEM

CROSS-REFERENCE TO RELATED APPLICATIONS

None.

BACKGROUND

The embodiments herein relate generally to sports equipment, and more particularly, to a light source illuminating the rim, net, and backboard of a basketball system.

When a person wants to play basketball outside, but it is too dark, it can be difficult to see the basketball and whether or not the ball went through the basketball rim. It may also be difficult to pick up the ball as it rebounds from a missed shot. Sometimes the rebound comes right back at the person, who picks up the sight of the ball too late because the shooter (the user) could not see the ball hit the rim.

In some cases, there are light up basketballs, but the basketball hoop remains in the dark, which makes it difficult to gauge where the rim is located.

Other basketball hoop lighting systems have requirements including for example: 1. Needing an AC power source to plug into. 2. They can be very difficult to assemble with long arms attached to and hanging over the top of the backboard. 3. The light bulbs can break easily when hit by a basketball. 4. The arms holding the lights can break or be a hazard hanging above the backboard. 5. They can be very expensive and may need professional installation like an electrician or laborer.

Some consumer basketball hoop lighting systems are flood lights that shine down from above or the side. This can create unwanted shadows and glaring light that obstructs the user's view when playing and shooting the basketball. The direct light from an above flood light can cast unwanted shadows on the backboard and court. It can shine directly down into your eye making it difficult to aim when shooting the basketball. Lighting from above illuminates the top of the hoop however, the shooter is usually underneath the hoop.

As can be seen, there is a need for an improved basketball that addresses the aforementioned problems.

SUMMARY

According to one aspect of the subject technology, an illumination system for basketball rims id disclosed. The system comprises: a light source coupled to the basketball rim and mounted underneath the basketball rim, disposed to shine light upward onto the basketball rim; and a power source connected to the light source.

According to another aspect, an illumination system for basketball rims is disclosed. The system comprises: an L.E.D. strip of light arranged in a hoop and mounted directly underneath in alignment with, and spaced from, a basketball rim, wherein the L.E.D. strip of light is generally on and illuminating a default solid light or pattern when in use; a diffuser on the L.E.D. strip of light, wherein a power source connected to the L.E.D. strip of light; a bungee cord coupling the L.E.D. strip to attachment loops of the basketball rim; a rebound sensor connected to the light source and configured to: detect when a basketball shot makes impact with the basketball rim or impact with a basketball backboard element, and send a signal to the L.E.D. strip in response to the detection of impact with the basketball rim or with the backboard element, wherein the L.E.D. strip is further configured to illuminate to indicate a rebound, and wherein illumination of the L.E.D. strip in response to detection by the rebound sensor is a different type of illumination than the default solid light or pattern illumination of the L.E.D. strip when in use; a score sensor disposed for placement in a basketball net connected to the basketball rim, wherein the score sensor is connected to the light source and configured to: detect when a basketball shot travels through an interior of the basketball net, and send a signal to the L.E.D. strip in response to the detection of the basketball shot travelling through the interior of the basketball net, wherein the L.E.D. strip is further configured to illuminate to indicate a made basket, and wherein illumination of the light source in response to detection by the score sensor is a different type of illumination than the default solid light or pattern illumination of the L.E.D. strip when in use.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

The word "exemplary" is used herein to mean "serving as an example or illustration." Any aspect or design described herein as "exemplary" is not necessarily to be construed as preferred or advantageous over other aspects or designs.

In general, and referring to FIGS. 1-5, a basketball illumination system 10 (sometimes referred to generally as the "system 10") is shown according to an exemplary embodiment. The subject disclosure will describe both the mechanical aspects as well as the advantages in the processes for mounting the system to a basketball rim 11*c*. Generally, the embodiments provide illumination of the basketball rim 11*c* from a bottom position/perspective that provides an advantage over lighting that is above a rim. The system 10 shines light that is visible on the outside surface of the rim 11*c* as well as on surrounding surfaces of a basketball rim and backboard 11*b*.

Figure 1:
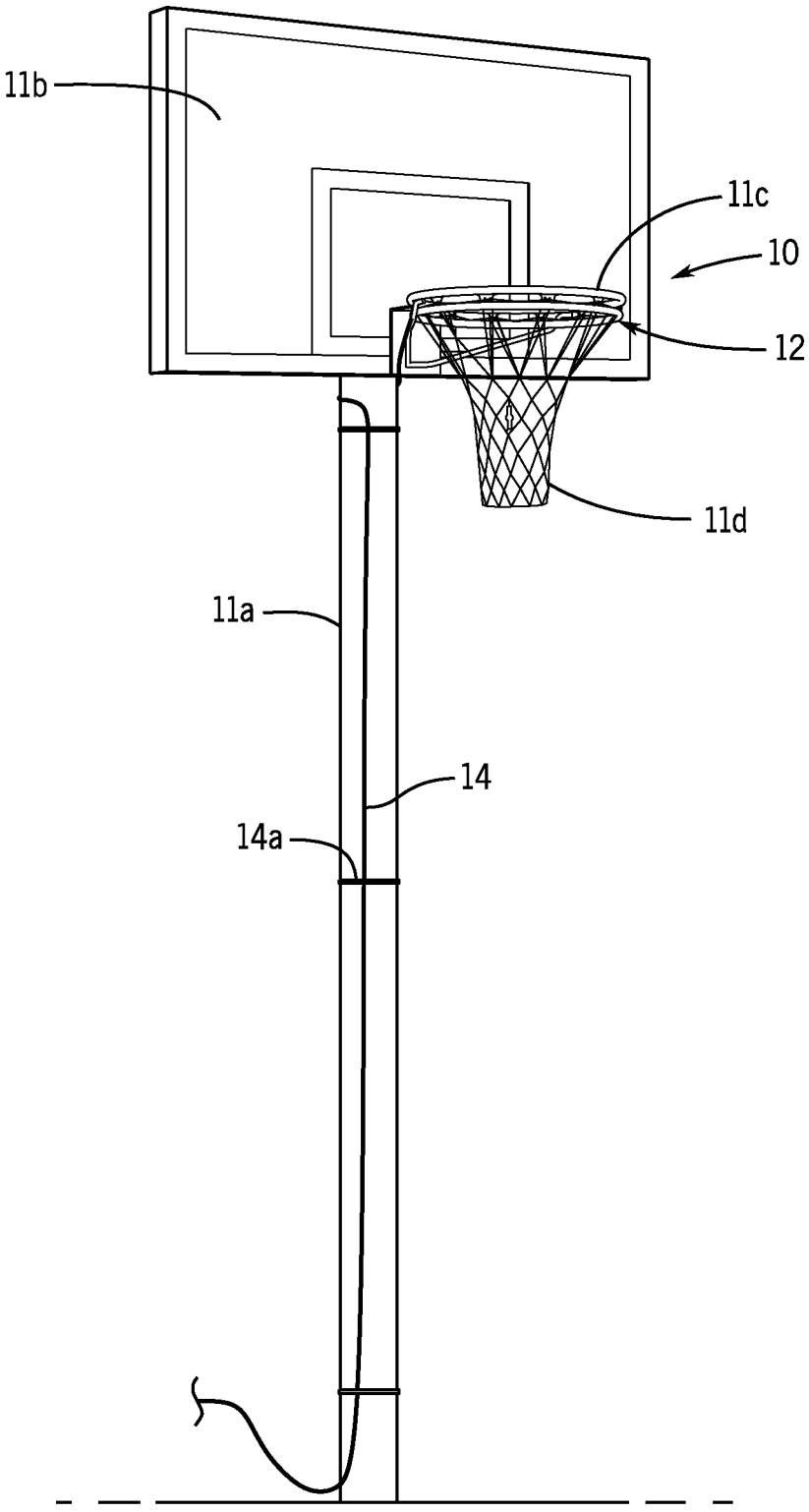
FIG. 1 is a perspective front view of an illuminated basketball system in accordance with an exemplary embodiment of the subject technology.

Referring now to FIG. 1, the system 10 is shown mounted to a basketball court system according to an exemplary embodiment. The basketball court system includes a pole 11*a* onto which the backboard 11*b* is mounted. The basketball rim 11*c* is mounted to the backboard 11*b* via a brace plate 11*e* and brace arms 11*f*. A net 11*d* is generally attached to the rim 11*c*. The system 10 includes a light source 12, which may be for example, a flexible strip of light formed into a hoop that may be approximately the same size (circumference) as the rim 11*c*. The light source 12 may be for example, an L.E.D. strip. The light source 12 may be mounted underneath the rim 11*c*. The light source 12 is generally on when powered and in-use. A default setting for illumination may be a solid color or a pattern of flashing light. In some embodiments, the light source 12 may be powered through a plugged-in wire 14. However, as will be seen, other forms of power may be incorporated either in conjunction with the power wire 14 or as standalone sources.

Referring now to FIGS. 2, 3, 4, 4A and 5, the system 10 is shown mounted to the rim 11*c* according to an exemplary embodiment. The light source 12 may comprise an assembly 17 which in an exemplary embodiment may include an L.E.D. strip 18*e* (comprising one or more L.E.D.$) that may be placed through the circumference of the light source 12's housing 18*d*. In some embodiments, the L.E.D strip 18*e* may include a diffuser 18*a* that diffuses the light from the L.E.D.(s) so that the light envelopes the rim 11*c* (from the perspective of a user) and prevents glare emanating from any particular point on the hoop 12. Generally, the light source 12 shines light upward toward the rim 11*c* and beyond to adjacent basketball elements.

Generally, a rim 11*c* includes mounting hooks 11*g* onto which loops of the basketball net 11*d* are hung to support the net 11*d* to the rim 11*c*. In some embodiments, the system 10 may be mounted to the mounting hooks 11*g* to position the hoop 12 under the rim 11*c*. In an exemplary embodiment, the system 10 may include a bungee cord 18*b* which may be attached to the light source 12. The bungee cord 18*b* may have sufficient tension to maintain the light source 12 in a position hanging tightly underneath the rim 11*c*. In an exemplary embodiment, the light source 12 may be positioned in alignment directly under the rim 11*c* (with some gap between the two elements). The amount of tension defining the amount of gap between the rim 11*c* and the light source 12 may be based on tension anchors 18*c* which may be at evenly distributed intervals between the mounting hooks 11*c* when the system 10 is mounted.

As will be appreciated, this method of mounting keeps the system 10 from drifting too far into the path of a successful shot. While the system 10 may move slightly when a basketball passes through the net 11*c*, and some impact with the ball may be experienced, it will be appreciated that the tension mounting of the hoop (light source 12) in its alignment with the rim 11*c* minimizes the force of routine impact with a basketball. This itself provides longevity for the system 10. The alignment, position, and tension also prevents the system 10 from interfering with shots and returns the light source 12 back to alignment with the rim 11*c* after each shot.

In another aspect that should be appreciated, by positioning the system 10 under the rim 11*c*, the light is unobstructed by the rim 11*c* from the perspective of the user and is indirect, which avoids blinding the user or interfering with sight of the rim 11*c*. Other system may instead position a light above the rim 11*c* or around the exterior surface of the rim 11*c* which may generate points of direct glare as a user gazes at the rim 11*c* during the process of shooting. Yet, the rim 11*c*, the net 11*d*, and the backboard 11*b* when used with the system 10 are illuminated indirectly so that the user may aim accurately even in ambient low-lit conditions.

Figure 2:
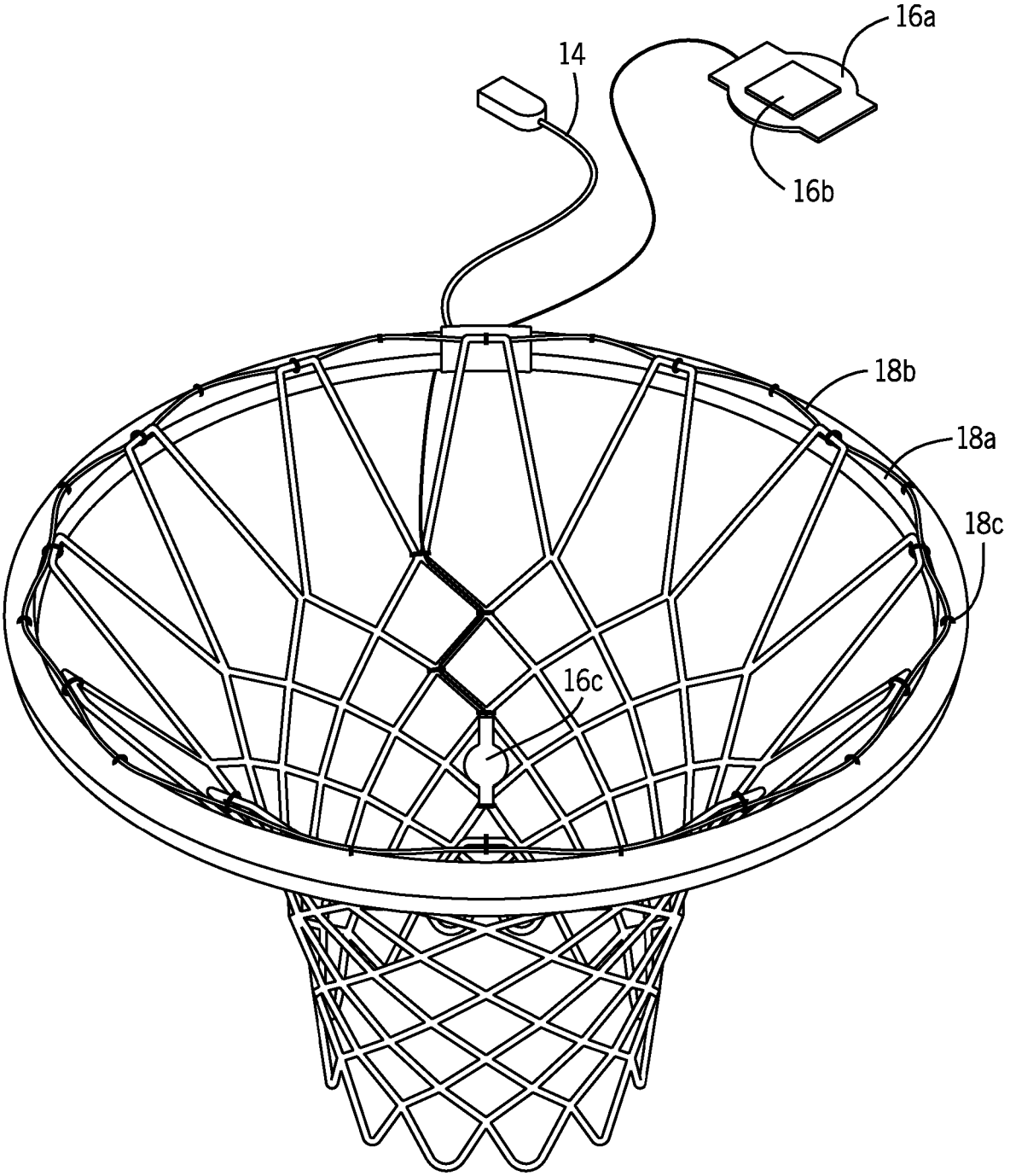
FIG. 2 is a perspective top view of an illumination system mounted to a basketball net in accordance with an exemplary embodiment of the subject technology.
Figure 3:
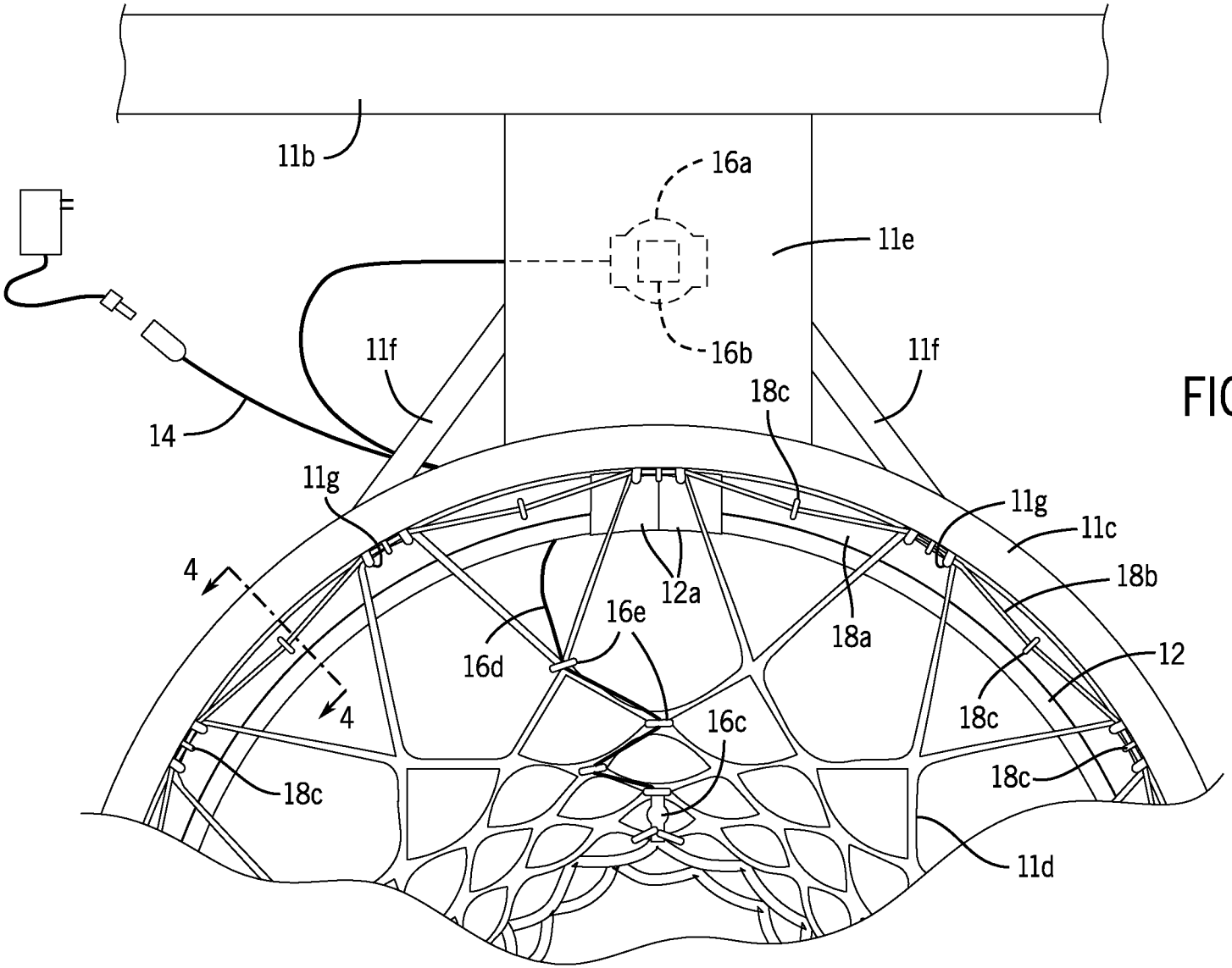
FIG. 3 is a partial top view of the illumination system of FIG. 2 attached to a basketball rim and further showing placement of a sensor and power source connection in accordance with an exemplary embodiment of the subject technology.
Figure 4:
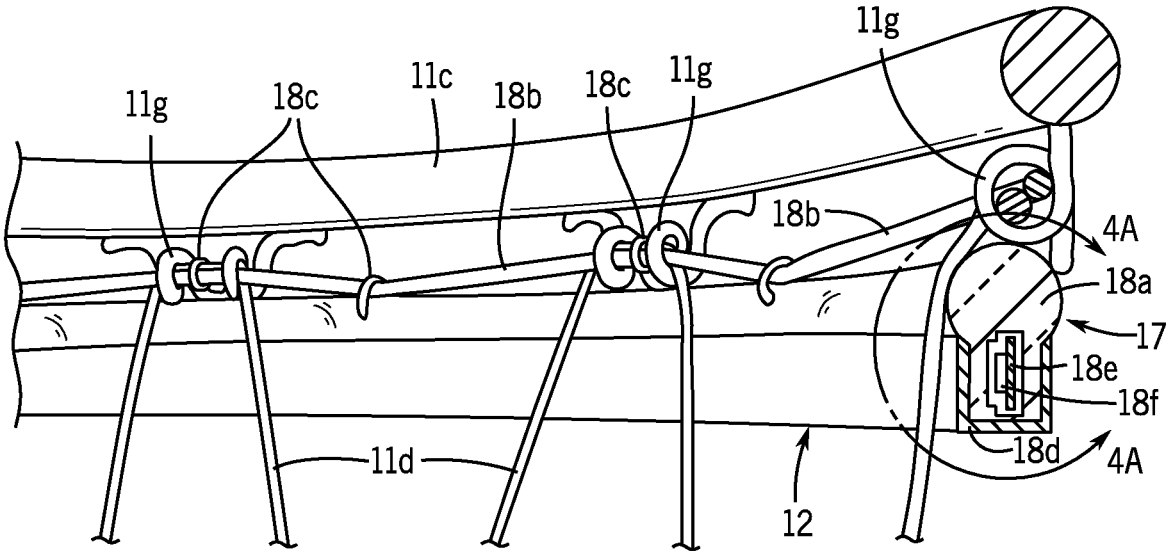
FIG. 4 is a sectional, internal side view of the illumination system of FIG. 3.
Figure 4A:
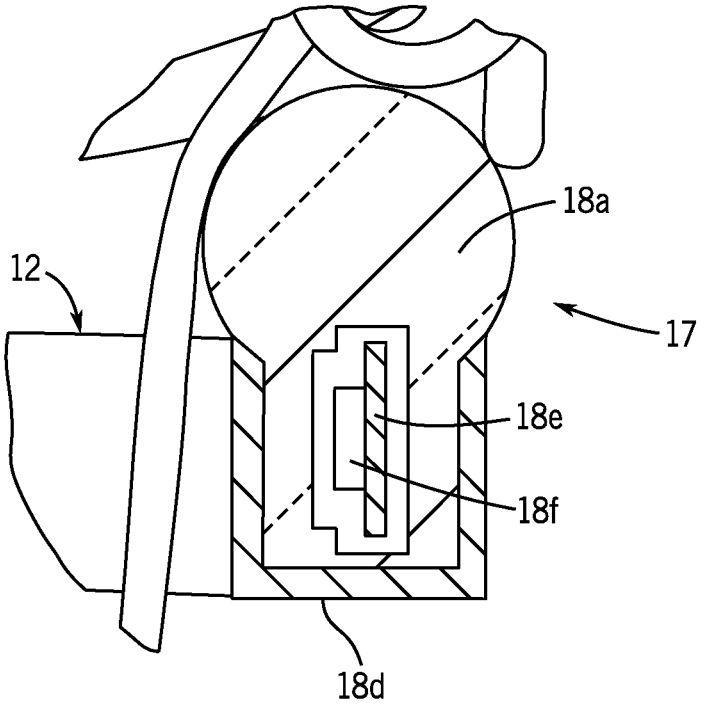
FIG. 4A is an enlarged view of the circle 4A shown in FIG. 4.
Figure 5:
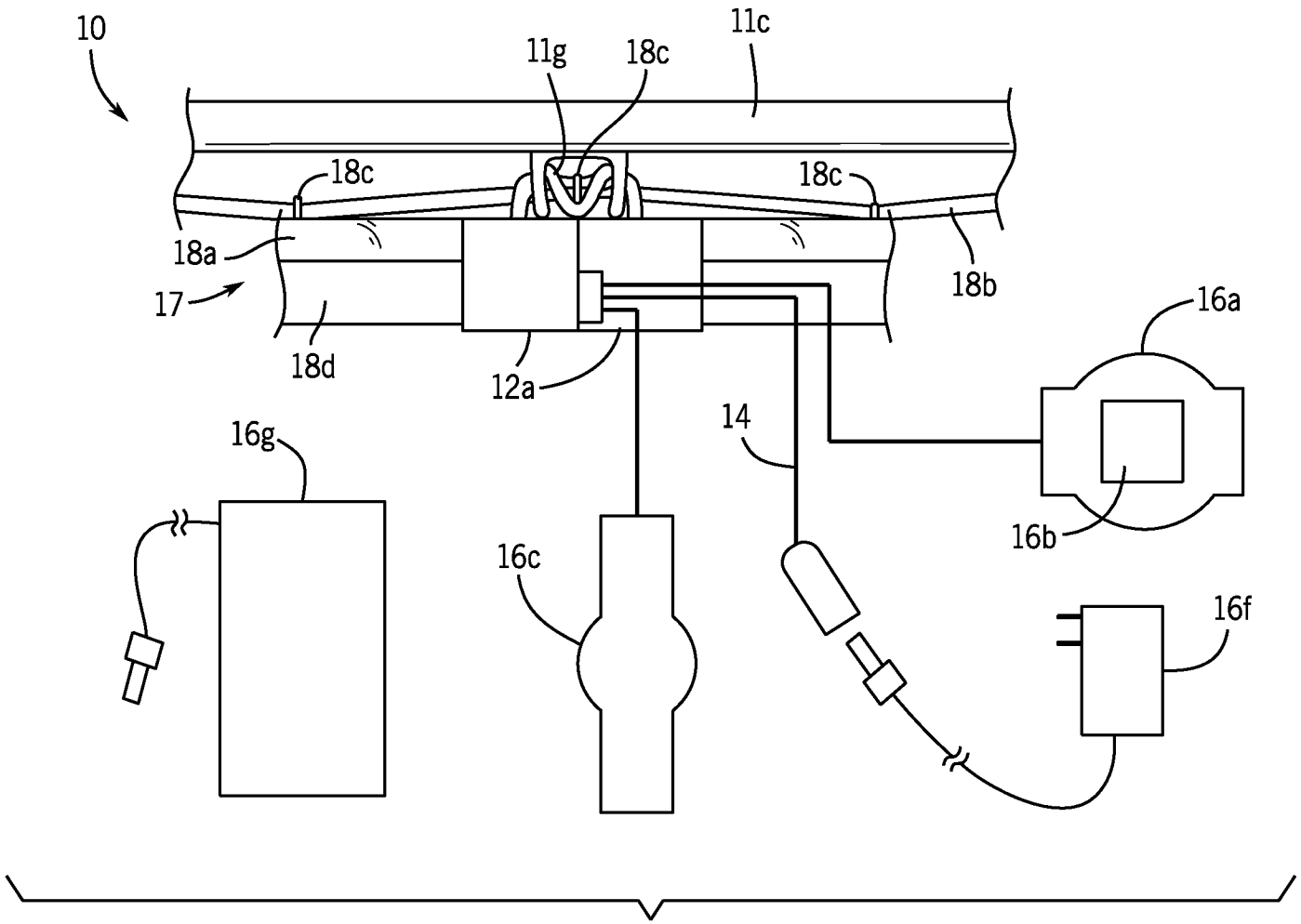
FIG. 5 is a partial side view of the illumination system of FIG. 3 showing electrical elements of the system connected to the light source in accordance with an exemplary embodiment of the subject technology.

Referring now to FIGS. 2, 3, and 5, some embodiments of the system 10 may include additional features for augmenting the illuminated basketball experience. For example, the system 10 may include sensors for detecting rebounds and successful shots (a rebound sensor 16*a* and score sensor 16*c*). The rebound sensor 16*a* may be configured to detect a missed shot that bounces off the basketball system; for example, when a basketball impacts the rim 11*c* but does not go through the rim, or when a basketball impacts the backboard 11*b* or any of its connected parts. The score sensor 16*c* may be configured to detect a successfully made basket. The rebound sensor 16*a* and score sensor 16*c* may be for example, piezoelectric discs.

The rebound sensor 16*a* may be configured to send a signal to the light source 12 to activate the L.E.D. strip 18*e* to illuminate a certain color (or light flashing pattern) when the sensor 16*a* is triggered. The illumination color or pattern indicating a rebound may be different than the default illumination of the light source 12 in its generally on status. The rebound sensor 16*a* may be positioned off of the net 11*d*, for example, on the backboard 11*b*, the backboard brace 11*e*, or one of the brace arms 11*f*. Generally, the backboard sensor 16*a* is placed on a surface that is not in direct line of contact with a basketball shot from the front or side of the rim 11*c* (for example, on a bottom or rear surface of one of the aforementioned backboard elements). In some embodiments, a magnet 16*b* (for example, a neodymium magnet) may be attached to the rebound sensor 16*a*, which helps hold the rebound sensor 16*a* to a metal surface of the backboard elements.

The score sensor 16*c* may be configured to detect when a basketball pass through the rim 11*c* and down the net 11*d*. The score sensor 16*c* may be positioned in the net 11*c*. The score sensor 16*c* may be connected to a score sensor wire 16*d* attached the net 11*c* loops by fasteners 16*e*. In operation, the score sensor 16*c* detects when a basketball travels through the interior of the net 11*c*. The score sensor 16*c* may be configured to send a signal to the light source 12 to activate the L.E.D. strip 18*e* to illuminate a certain color (or light flashing pattern) when the score sensor 16*c* is triggered. The light output from the score sensor 16*c* may be different than the output by the rebound sensor 16*a* or of the illumination associated with the light source's default on appearance.

In some embodiments, the power source for the light source 12, may be an AC adapter 16*f* (which is connected to another power source) or may be a rechargeable battery 16*g*. In addition, some embodiments may include a controller 18*f* which may be a circuit that may operate control of the on/off operation of the system, the color of lights shown and/or light pattern for the default lighting, for the rebound detection illumination, for the score detection illumination, and detection sensitivity of sensors. The rebound sensor 16*a* and score sensor 16*c* may work independently of each other. In a scenario where both sensors trigger simultaneously, the controller 18*f* may be configured to give priority to operation of the score sensor 16*c*. In addition, while not shown, some embodiments may include a remote control which may communicate wirelessly with the controller 18*f* so that the user may operate the on/off status and lighting features of the system.

Persons of ordinary skill in the art may appreciate that numerous design configurations may be possible to enjoy the functional benefits of the inventive systems. Thus, given the wide variety of configurations and arrangements of embodiments of the present invention the scope of the present invention is reflected by the breadth of the claims below rather than narrowed by the embodiments described above.

What is claimed is:

1. An illumination system for basketball rims, comprising:

a light source coupled to the basketball rim and mounted underneath the basketball rim, disposed to shine light upward onto the basketball rim;

a rebound sensor connected to the light source and configured to:

detect when a basketball shot makes impact with the basketball rim or impact with a basketball backboard element, and send a signal to the light source in response to the detection, wherein the light source is further configured to illuminate to indicate a rebound; and a power source connected to the light source.

2. The system of claim 1, wherein:

the light source is a strip of L.E.D. light(s) arranged in a hoop, wherein the hoop is aligned directly below the basketball rim when the light source is mounted to the basketball rim.

3. The system of claim 2, further comprising:

a diffuser on the L.E.D. strip, wherein the diffuser is configured to diffuse the light shone upwards around the front of the basketball rim.

4. The system of claim 1, further comprising a bungee cord configured to couple the light source to attachment loops of the basketball rim.

5. The system of claim 4, further comprising tension anchors evenly distributed around the bungee cord and positioned for placement between the attachment hoops of the basketball rim.

6. The system of claim 1, wherein illumination of the light source in response to detection by the rebound sensor is a different type of illumination than a default illumination of the light source in general operation.

7. The system of claim 1, further comprising:

a score sensor disposed for placement in a basketball net connected to the basketball rim, wherein the score sensor is connected to the light source and configured to:

detect when a basketball shot travels through an interior of the basketball net, and send a signal to the light source in response to the detection, wherein the light source is further configured to illuminate to indicate a made basket.

8. The system of claim 7, wherein:

illumination of the light source in response to detection by the shot sensor is a different type of illumination than a default illumination of the light source in general operation.

9. An illumination system for basketball rims, comprising:

an L.E.D. strip of light arranged in a hoop and mounted directly underneath in alignment with, and spaced from, a basketball rim, wherein the L.E.D. strip of light is generally on and illuminating a default solid light or pattern when in use;

a diffuser on the L.E.D. strip of light, wherein a power source connected to the L.E.D. strip of light;

a bungee cord coupling the L.E.D. strip to attachment loops of the basketball rim;

a rebound sensor connected to the light source and configured to:

detect when a basketball shot makes impact with the basketball rim or impact with a basketball backboard element, and send a signal to the L.E.D. strip in response to the detection of impact with the basketball rim or with the backboard element, wherein the L.E.D. strip is further configured to illuminate to indicate a rebound, and wherein illumination of the L.E.D. strip in response to detection by the rebound sensor is a different type of illumination than the default solid light or pattern illumination of the L.E.D. strip when in use;

a score sensor disposed for placement in a basketball net connected to the basketball rim, wherein the score sensor is connected to the light source and configured to:

detect when a basketball shot travels through an interior of the basketball net, and send a signal to the L.E.D. strip in response to the detection of the basketball shot travelling through the interior of the basketball net, wherein the L.E.D. strip is further configured to illuminate to indicate a made basket, and wherein illumination of the light source in response to detection by the score sensor is a different type of illumination than the default solid light or pattern illumination of the L.E.D. strip when in use.

10. An illumination system for basketball rims, comprising:

a light source coupled to the basketball rim and mounted underneath the basketball rim, disposed to shine light upward onto the basketball rim;

a score sensor disposed for placement in a basketball net connected to the basketball rim, wherein the score sensor is connected to the light source and configured to:

detect when a basketball shot travels through an interior of the basketball net, and send a signal to the light source in response to the detection, wherein the light source is further configured to illuminate to indicate a made basket, wherein illumination of the light source in response to detection by the shot sensor is a different type of illumination than a default illumination of the light source in general operation; and a power source connected to the light source, and a rebound sensor connected to the light source and configured to:

detect when a basketball shot makes impact with the basketball rim or impact with a basketball backboard element, and send a signal to the light source in response to the detection, wherein the light source is further configured to illuminate to indicate a rebound.

11. The system of claim 10, wherein:

the light source is a strip of L.E.D. light(s) arranged in a hoop, wherein the hoop is aligned directly below the basketball rim when the light source is mounted to the basketball rim.

12. The system of claim 11, further comprising:

a diffuser on the L.E.D. strip, wherein the diffuser is configured to diffuse the light shone upwards around the front of the basketball rim.

13. The system of claim 12, further comprising a bungee cord configured to couple the light source to attachment loops of the basketball rim.

14. The system of claim 13, further comprising tension anchors evenly distributed around the bungee cord and positioned for placement between the attachment hoops of the basketball rim.

15. The system of claim 10, wherein illumination of the light source in response to detection by the rebound sensor is a different type of illumination than the default illumination of the light source in general operation.

* * * * *